US005341568A

United States Patent [19]

Bricmont et al.

[11] Patent Number: 5,341,568

[45] Date of Patent: Aug. 30, 1994

[54] INSULATED FURNACE ROLLER AND METHOD OF MANUFACTURE

[75] Inventors: Francis H. Bricmont, Pittsburgh; Hugh B. Carr, McMurray, both of Pa.

[73] Assignee: Bricmanage, Inc., McMurray, Pa.

[21] Appl. No.: 88,815

[22] Filed: Jul. 9, 1993

Related U.S. Application Data

[62] Division of Ser. No. 840,147, Feb. 24, 1992, Pat. No. 5,230,618.

[51] Int. Cl.[5] ..... B23P 15/00

[52] U.S. Cl. ..... 29/895.32; 29/895.21; 29/895.213; 492/30; 432/236

[58] Field of Search ..... 432/236, 246; 165/90, 165/91; 492/30-36; 29/895.32, 895.31, 895.213, 895.21

[56] References Cited

U.S. PATENT DOCUMENTS 2,021,913 11/1935 Fallon .
2,428,965 10/1947 Frisco et al. .
3,860,387 1/1975 Bricmont ..... 432/246
4,466,456 7/1984 Kameyama et al. ..... 164/488
4,991,276 2/1991 Bricmont .
5,161,306 11/1992 Nakahira et al. ..... 29/895.32
5,167,067 12/1992 Sundstedt et al. ..... 29/895.21

*Primary Examiner*—Irene Cuda
*Attorney, Agent, or Firm*—Clifford A. Poff

[57] ABSTRACT

A method of manufacturing an insulated furnace roller includes providing the roller with an insulating refractory castable between the spaced apart tires of the roller and between the outermost tires and the furnace walls, the castable being secured to an arbor of the roller by metal anchors having outer ends that terminate inwardly of the outer surface of the castable, and wherein between the tires and the castable spacer discs are provided and between openings formed by the discs and tires insulation is inserted, the arbor being also wrapped with insulation before the castable is formed on the arbor.

11 Claims, 3 Drawing Sheets

INSULATED FURNACE ROLLER AND METHOD OF MANUFACTURE

This application is a division of U.S. application Ser. No. 07/840,147, filed Feb. 24, 1992, now U.S. Pat. No. 5,230,618.

BACKGROUND OF THE INVENTION

The present invention relates to an improved insulated furnace roller, and in particular to such rollers employed in high temperature furnaces for heating or reheating metallic workpieces incident to their being processed, for example, by rolling.

U.S. Pat. Nos. 3,860,387 and 4,991,276, as well as U.K. Patent No. 429,626 relate to rollers for conveying workpieces, such as metal slabs, plates and strips in such furnaces. The disclosed rollers comprise inner arbors for supporting outer tubes, sleeves or tires which support the horizontally disposed workpieces as they pass through the furnace. The arbors of these patents are internally air or water cooled to structurally protect the arbors from the intense heat that may in the case of the U.S. patents be in excess of 2000° F. To further protect the arbors from being overheated, which would cause their structural failure, and to prevent the cooling effect of the arbors from adversely affecting the ability of the furnace to heat the workpieces to the desired temperature, insulation is provided for the rollers disclosed in the three patents between the arbors and the tubes, sleeves or tires.

To a great extent the success of past roller designs to operate over a long period of time in the environment involved were directly dependent on the ability of the insulation scheme employed to effectively insulate the rollers in carrying out the above two objectives. Past designs have repeatedly failed to do this due to the nature and structure of the insulation used and the manner and technic of applying the insulation to the rollers. Adding to the problem is the fact that the roller are caused to deflect under the weight of the workpiece. The past failures has revealed that what is needed is an insulation scheme that will bring together the proper types and structures of insulations and the manner and technic of applying the insulations to allow the rollers to operate in the severe conditions and roller deflection without the insulations quickly deteriorating and/or becoming detached from the rollers.

SUMMARY OF THE INVENTION

The present invention has for its object to provide an improved insulated furnace roller of the type, for example, disclosed in U.S. Pat. No. 4,991,276 (276) and a method of manufacturing such a roller.

A further object of the invention is to provide an improved insulated furnace roller of the type, for example, disclosed in the 276 patent, including a castable insulation member mounted concentric with the arbor of the roller, the castable being secured to the arbor by anchors secured to the arbor, which extend into the castable to a position inward of its outer surface, the arbor being provided with additional insulation between the castable and the arbor.

An additional object of the invention of the above described insulated roller is to secure to each side of the tires of the roller spacer disc like members that extend to the outer periphery of the tires between the adjacent ends of the castable and the tires.

Another object of the invention is to provide in the above described insulated roller a wrapping applied around the arbor before the castable is mounted on the arbor, the wrapping being a felt insulation tape and covered with a vinyl tape and constructing the roller to allow for the difference in thermal expansion between the castable and the anchors by providing a coating spacer material that upon heating will provide an expansion zone between the anchors and the castable and including in the castable stainless steel needle like elements.

A still further object of the invention is to provide in the above described insulated roller securing masonite or the like spacer disc like members between the walls of the tires and the castable which disc will provide an expansion zone at a furnace temperature, and in insulating all significant open areas between the castable and members and the tires, such as between the fingers of the tires and the openings between the members and adjacent surfaces of the tires.

Another object of the invention is to provide in the above described insulated roller a construction of the anchors which are arranged between the furnace walls and tires to be made to extend further beneath the outer surface of the castable than the anchors arranged between the tires.

An additional object of the invention is to provide a method of manufacture of the above described roller, wherein a mold is formed over the arbor after the arbor has been insulated and water proof tape has been applied thereto and spacers have been applied to the tires and the castable, in which the mold is formed from a liquescent thermal heat resistant insulation or refractory capable of creating a high strength castable.

BRIEF DESCRIPTION OF THE DRAWINGS

These objects and advantages, as well as others, will become better understood when the following description is read along with the accompanying drawings of which.

DESCRIPTION OF THE PREFERRED EMBODIMENT

Figure 1:
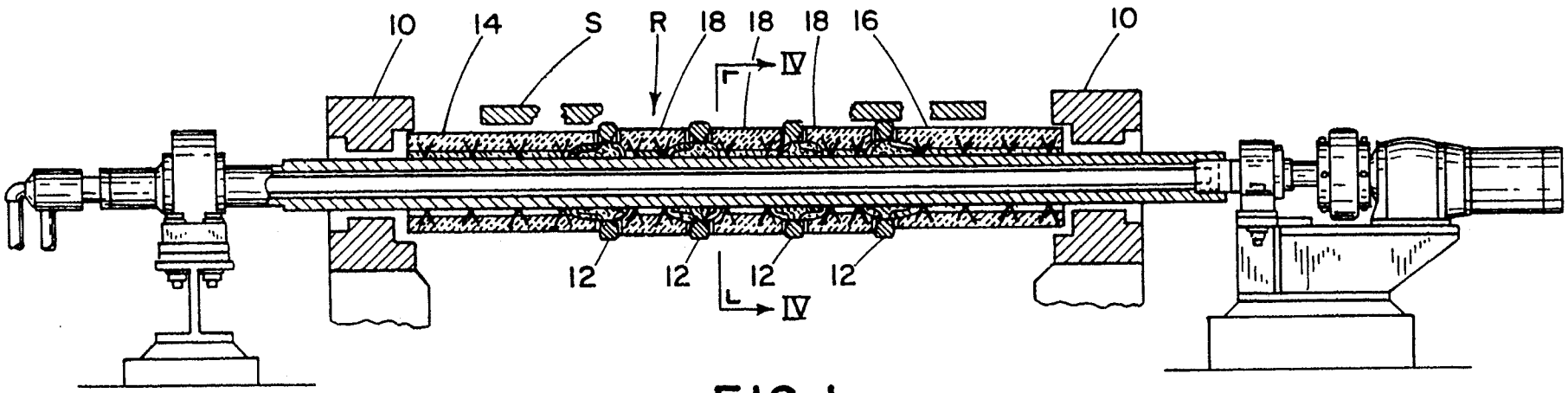
FIG. 1 a partial sectional elevational view of an insulated furnace roller constructed in accordance with the present invention.

With reference to FIG. 1 there is illustrated one of a number of spaced apart horizontally arranged furnace rollers R for use in a strip heating furnace 10, the furnace and roller R, except for the insulating scheme of the roller, following generally the teaching of the 276 patent and therefore will not be described in detail. It is important for the purpose of describing the invention, however, to identify specifically the four spaced apart cobalt tires 12 of the roller R, the strip S supported by the tires and the fact that the roller is made up of two outer axial end portions 14 and 16 that extend between the two outermost tires and the adjacent furnace walls and three inner axial portions 18 that extend between the tires 12.

It will be appreciated that the present invention with respect to the insulation scheme can be used with constructions of workpiece support members other than the tires 12. Also it is to be understood that the reference to "insulation scheme" as used herein is meant to pertain to the nature, type and structure of the insulations used in combination with the roller and to the technic of applying, securing and using the insulations with the roller to obtain the advantages of the invention, the primary object being an insulation scheme that will avoid rapid deterioration, in which the insulation will not become detached from the arbor and tires over a long operating period, notwithstanding the severe operating temperatures and differences in thermal rates of expansion between the insulations and the tires and other elements of the roller.

Figure 3:
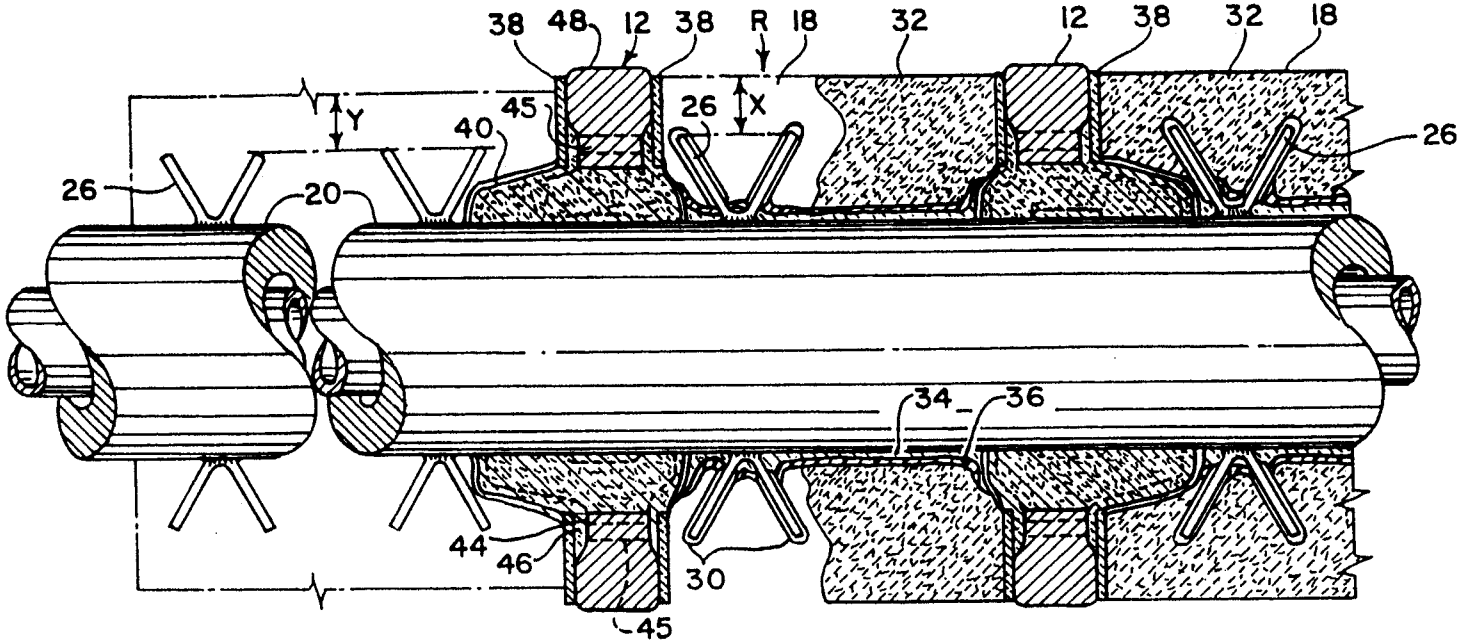
FIG. 3 is an enlarged view of a portion of FIG. 1 illustrating two of the tires of the roller.
Figure 2:
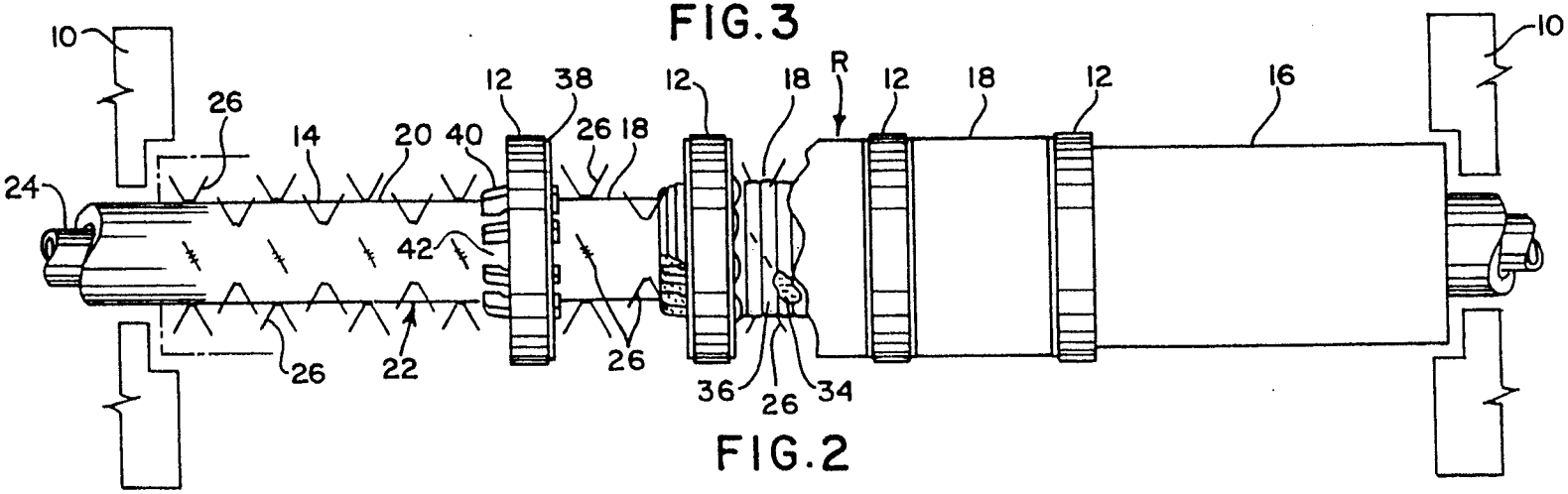
FIG. 2 is a view similar to FIG. 1, except for the omission of certain elements, illustrating in several axis sections of the roller certain manufacturing conditions or phases of the roller.
Figure 4:
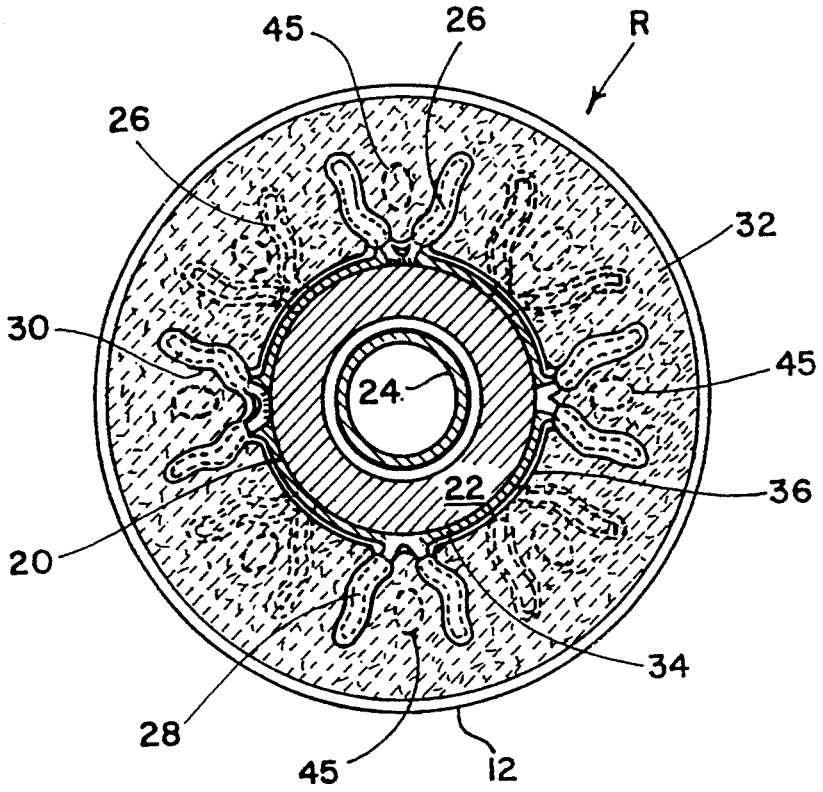
FIG. 4 is a sectional view taken on lines IV—IV of FIG. 1.

FIGS. 2, 3 and 4 will be now referred to in describing the novel insulated furnace roller and the novel method of its manufacture. FIG. 2 is designed to illustrate certain aspects of the process of the manufacture of the roller R as viewed from left to right. With reference first to the left hand portion of the roller R, there is shown a section 20 of the arbor 22 of the roller which receives a water cooling pipe 24 which supplies cooling water for the arbor as disclosed in the 276 patent. On the periphery of the section 20 and the other sections of the arbor there is welded to the arbor the inner ends of anchors 26, the opposite ends of the anchors extending in the form of a general "V" radially outward from arbor 22. Each leg of the anchors have a diameter of approximately 0.25", the legs formed into a single loop 28, seen best in FIG. 4, the anchors being formed of #310 alloy stainless steel, and being arranged in off setting rows, as one views FIGS. 2 and 4 at 90° and 45° around the arbor.

As shown, the anchors are axially equally spaced apart and rotated 60° from the roll shaft axis, this being only shown in the central row as one views FIG. 2, in the portions 14 and 16 of the roller R, in which there is provided three radial rows of anchors and in the portions 18 two radial rows of anchors are provided, wherein at the 45° row there are three and one anchors provided, respectively. The anchors for the portions 14, 16 and 18 are provided with a spacer material of a hot dip coating of cellulose acetate butyrate material 30, best shown in FIG. 3, of approximately 1/16" thick over the entire length to within approximately ½ of the arbor 22. The coating 30 as provided will prevent bonding between the anchors and castable by melting at between approximately 300° F. to 375° F. affording a space or clearance between the metallic anchor and the castable material. This will prevent physical contact between the two due to the difference in expansion and contraction between the two at the elevated furnace temperature to prevent the anchors from applying a compression or tensile force on the castable. In FIG. 3, the clearance is represented by the space shown between the anchor and castable. The space coating can be of the type supplied by Evans Manufacturing, Inc. known as "Peel Coat" Type II.

In certain applications of the roller R the outer ends of the anchors can be provided with plastic caps wrapped with a rubber or plastic tape or by use of only the tape for a minimum coverage of approximately 1/32". These coverings, as well as others suitable known materials, whether by melting, softening, flexing or dissolving when subject to the furnace heat will provide the desired space before the thermal growth of the metal will stress the castable. The lengths of the anchors in the portions 18 of the roller R are approximately 2½ with approximately ⅞ between the outer ends of the anchors and the outer surface the castable 32. In order to reduce the temperature of the anchors in the portions 14 and 16 of the roller R, the lengths are reduced to 1⅝ and the distance between the tips of the anchors and the outer surface of the castable is made approximately 1⅛. This difference in construction of the anchors is represented by the legends X and Y in FIG. 3, the outer anchors being identified by the Y and is provided for such anchors to reduce peeling of the castable in the portions 14 and 16 due to the difference in conditions that exist between these two portions and the portions 18.

After the anchors have been welded to the arbor 22, the periphery of the arbor is wrapped with insulating felt tape 34 which is covered with waterproofing vinyl tape 36, shown best in FIG. 3, the latter serving to protect the felt tape 34 from the liquid insulating material used to form the refractory castable 32. The thickness of the felt tape 34 is of the order of approximately 1/16". After the vinyl tape 36 is applied, to each side of the tires 12 a pressurized board or hardboard, such as a tempered type masonite spacer disc 38 is glued or otherwise attached in two halves, the disc circumventing the arbor 22, as shown in FIG. 3, and extending to slightly below the periphery of the associated tire, as shown best in FIG. 2. The thickness of the discs are approximately ⅛ and are characterized by being relatively stable and having an outer surface relatively impervious to liquid.

The masonite is used as a spacer which will disintegrate at a relatively low furnace temperature and provide a space or clearance represented by the original thickness, thereby to allow for the excessive thermal expansion of the cobalt cast tire, and contact that would be caused by deflection of the arbor under its load, which would otherwise cause the tire to contact the adjacent surface of the castable and apply a force thereto. Masonite will combust at between approximately 750° F. and 800° F. This construction allows for the fact that the thermal expansion of the cobalt cast tires exceeds the contraction of the castable material at all temperatures through 2100° F. This can result in the castable being placed in a state of compression and the castable can rupture when the castable abuts the tires.

This state of compression, in one example, is brought about by the fact that the linear change through thermal expansion of the cobalt tires at 1000° F. is approximately plus $14.9\times10^{-6}$ per °F. per inch, and the linear change in the refractory castable is approximately minus 0.3%. A 2" wide tire will expand approximately 0.028" and the castable will be contracted at 0.024" resulting in the tire potentially exerting a crushing force on the castable, which force can be augmented by contact with the castable by the tire on deflect of the arbor. In the illustrated embodiment, the discs 38 are employed in view of the immediate bonding contact that would otherwise exist between the tires 12 and castable 32, which condition is not present between the arbor 22 and castable due to the insulation 34.

As shown in FIG. 2, the tires 12 at their bases are formed with axially extending fingers 40 being spaced apart around the arbor 22 so that an opening 42 exist between adjacent fingers. Also between the lower portions of the discs 38 and the webs 44 of the tires 12 are created void areas 46, the webs 44 being formed between the fingers 40 and rims 48 of the tires. The void areas 46 bulk ceramic insulation 50 is placed before discs are attached to the sides of the tires and into the openings 42 similar insulation is placed to further insulate the arbor 22 from the furnace heat via the tires and the tires from the cooling affect of the arbor 22. After the insulation 50 is inserted in the voids and openings, the entire adjacent areas of the bases of the tires are covered with waterproofing vinyl tape 52. The webs 44, as shown in FIG. 3, are provided with oval shaped openings 45 to avoid high stress risers from occurring in the webs, the outline of the openings being shown in background form in FIG. 4.

This manufacturing phrase is depicted in the first portion 18, at the left as one views FIG. 2 before the tape 52 is applied , the manufacturing phase of applying the tape is shown in the next adjacent portion of the arbor. The ceramic insulation 50 can be any of several thermal resistant commercial bulk insulations now on the market, such as for example 6PCF density bulk ceramic fibers.

Once the above manufacturing steps have been completed a mold 54 is formed and placed around the portions 14, 16 and 18 of the roller R, the mold taking, in one case, the form of a monotube circular waterproof treated paper, care being taken in the placement of the mold on the arbor to assure the castable 32 to be produced thereby will be concentric with the tires 12 and arbor 22.

Figure 5:
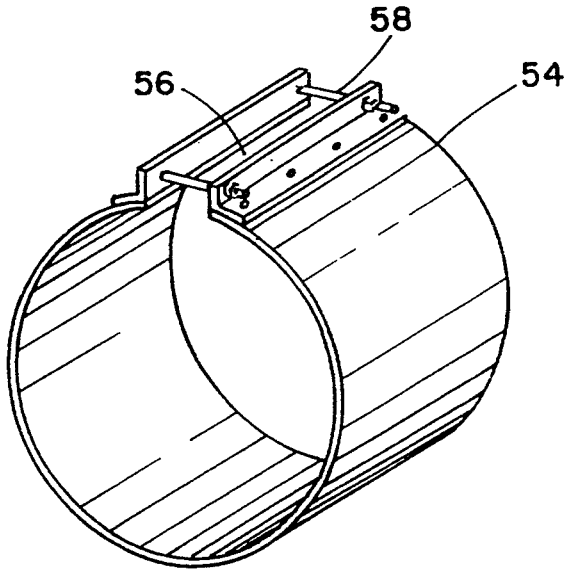
FIG. 5 is a perspective view of a mold used to form the castable shown in the other figures.

In FIG. 5 there is illustrated one form of a monotube paper form or mold 54 having a thickness of approximate 3/16", being formed of a commercial hard board tube and having an inlet pouring opening 56 and flanges at its opposite ends to be secured together around the arbor by fasteners 58. The mold can also be formed of a thin galvanized steel strip, in which case it can be made of a two piece construction for ease of assembly and disassembly. In casting the castable 32 by hydraulic action there is used a liquescent thermal resistance refractory insulation of a high strength type presently on the market, such as that manufactured by the Tradesmen Company, Refco Incorporated, type 110 - LW, with the addition of 3% by weight of stainless steel needles of a sized approximately ¾ long and 0.020" diameter. The particular technic of assuring the proper filling of the mold, the obtaining of a concentric shape and an even outer surface can follow well known practices. After the castable 32 is thus formed it is left to harden for approximately 24 hours after which the mold 54 is removed and the castable 32 is subject to curing at approximately 500° F. for approximately 16 hours.

The improved furnace insulated roller and the disclosed method of its manufacture will allow the operation of the roller in the extreme temperature environment to which reference has been made for long periods of operating times, wherein the arbor will be protected from the furnace heat otherwise transferred to the arbor and the workpiece supported by the tires will be protected from the cooling affect of the water cooled arbor. In a given arrangement the roller speed may be of the order of 4 to 40 RPM and be subject to a carrying weight of approximately 1950 lbs.

In essence, the insulating scheme and the creation of the anchor and tire clearance relationships of the present invention prevent the heat of the furnace from overheating the arbor, prevent the cooling of the arbor from being lost to the furnace chamber and hence cooling the chamber and allow the outer surfaces of the tires to be maintained at the furnace temperature. In a preferred embodiment of the invention, the arbor dimensions may be 5.0" outside diameter, wall thickness 1.0", being formed of ASTM A53 Grade A carbon steel tubing, water temperature being approximately 75° F. at 25 gpm, and a furnace temperature of approximately 2200° F. The heat transferred to the arbor by conduction from the tires will be offset by the predetermined cooling capacity of the water cooling system, as well as other heat gains through the insulation.

While the present invention has been described in accordance with the preferred embodiment, it is to be understood that other similar embodiments may be used or modifications and additions may be made to the described embodiment for performing the same functions of the present invention without deviating therefrom. Therefore, the present invention should not be limited to any single embodiment but rather construed in and scope in accordance with the recitation of the appended claims.

We claim:

1. A method of manufacturing a furnace roller for supporting a heated workpiece in a furnace, said roller including a rotatable arbor having internal means for receiving a coolant to cool the arbor and at least a pair of axially spaced apart tires secured to the arbor for rotation therewith, said tires including substantially equal radially extending portions for supporting the workpiece, said method comprising the steps of:

securing anchoring means to the arbor in a manner to form radially outwardly projecting anchoring ends between an adjacent pair of tires and within the radially extending portions of said pair of tires, covering at least the outer ends of said anchoring ends with a coating material of a type that will provide a stress relieving space between said anchoring ends and a thermal resistant castable means when subject to an operating temperature of the furnace, covering said arbor with an insulating material, applying a covering of a spacer material and securing the spacer material to the radially extending portions of said pair of tires to substantially cover said sides, said spacer material being of the type that at said operating temperature of the furnace will provide a stress relieving space between said radially extending portions of said tires and said thermal resistant castable means, forming said thermal resistant castable means around the arbor between a pair of said tires and over said anchoring means out of a liquescent thermal resistant insulating material in a manner that the thermal resistant castable means is secured to the arbor by said anchoring means and extends a distance radially outwardly from the arbor at a substantial distance but less than the radially extending portions of said pair of tires.

2. A method of manufacturing a furnace roller according to claim 1, wherein said anchoring means comprises stainless steel rod like members and said securing step is a welding step of welding the inner ends of said anchoring means to the arbor, in which said anchoring means are welded in an axially spaced apart relationship to each other, and said covering step comprises applying a coating of cellulose acetate butyrate material to the ends of said anchoring means.

3. A method of manufacturing a furnace roller according to claim 1, wherein said insulating material is made of ceramic fiber insulation tape like material and said spacer material takes the form of a relatively thin disc of masonite compared to the cross sectional thickness of said pair of tires.

4. A method of manufacturing a furnace roller according to claim 1, wherein said liquescent insulating material is formed from a high strength refractory insulating material containing approximately 3% by weight of randomly distributed stainless steel elements, and wherein after said securing step and said two covering steps have been completed the method includes the additional step of forming a mold around the arbor between a pair of said pair of tires to form said castable means, placing said liquescent material in said mold, allowing said liquescent material to harden in said mold, thereafter removing said mold, and allowing curing the castable means.

5. A method of manufacturing a furnace roller according to claim 4, wherein said curing step comprises subjecting said castable means to a temperature of approximately 500° F. for approximately 16 hours.

6. A method of manufacturing a furnace roller according to claim 1, including the additional step of forming said castable means so that it will be substantially concentric with the outer peripheries of a pair of said pair of tires.

7. A method of manufacturing a furnace roller according to claim 1, including the additional step of forming the anchoring means to project radially outwardly from the arbor between said pair of tires to an area adjacent to the outer surface of said castable means and inward of said outer surface.

8. A method of manufacturing a furnace roller according to claim 7 wherein said step of securing anchor means includes arranging said anchoring means to extend to an area of radially inward and close to subsequently formed outer surface of said thermal resistant castable means, and wherein said arbor includes opposite axial ends and portions that extend axially between said ends and adjacent tires, arranging said castable means around said extending portions of said arbor, said anchoring means including additional anchoring means, securing said additional anchoring means to said arbor extending portions, and arranging said additional anchoring means to extend in an area of said surface of said castable means inwardly of said anchoring means.

9. A method of manufacturing a furnace roller according to claim 1, wherein said liquescent insulating material comprises a mixture including silica and alumina.

10. A method of manufacturing a furnace roller according to claim 1, forming said spacer material in the form of discs out of a material that will disintegrate at a furnace temperature.

11. A method of manufacturing a furnace roller according to claim 1, wherein said coating material includes a material that will melt at said operating temperature of said furnace.

* * * * *